US012723834B2

(12) United States Patent
Hughes et al.

(10) Patent No.: US 12,723,834 B2
(45) Date of Patent: Sep. 1, 2026

(54) TRAINING FIREARM

(71) Applicant: NextLevel Training LLC, Ferndale, WA (US)

(72) Inventors: Michael Frank Hughes, Maple Falls, WA (US); Britton R Lentz, Everson, WA (US); Thomas Ryan Swetish, Bellingham, WA (US)

(73) Assignee: NextLevel Training LLC

( * ) Notice: Subject to any disclaimer, the term of this patent is extended or adjusted under 35 U.S.C. 154(b) by 213 days.

(21) Appl. No.: 18/635,173

(22) Filed: Apr. 15, 2024

(65) Prior Publication Data

US 2025/0321071 A1 Oct. 16, 2025

(51) Int. Cl.
*F41A 33/02* (2006.01)

(52) U.S. Cl.
CPC ..... *F41A 33/02* (2013.01)

(58) Field of Classification Search
CPC ..... G09B 19/003; F41A 33/00; F41A 33/02
See application file for complete search history.

(56) References Cited

U.S. PATENT DOCUMENTS

| | | | | |
|---|---|---|---|---|
| 9,746,271 | B2 * | 8/2017 | Hughes | F41A 19/69 |
| 10,775,125 | B1 * | 9/2020 | Owen, Jr. | F41A 33/00 |
| 10,788,289 | B1 * | 9/2020 | Wallace | F41J 5/10 |
| 11,703,297 | B2 * | 7/2023 | Seigler | F41A 19/06 434/16 |
| 2010/0233660 | A1 * | 9/2010 | Skala | F41G 3/2655 434/22 |
| 2011/0047847 | A1 * | 3/2011 | Hughes | F41A 19/16 42/84 |
| 2013/0316308 | A1 * | 11/2013 | Monti | H02K 41/031 434/16 |
| 2019/0041164 | A1 * | 2/2019 | Hughes | F41G 3/2655 |
| 2024/0060743 | A1 * | 2/2024 | Kern | F41A 33/00 |

* cited by examiner

*Primary Examiner* — Peter R Egloff
(74) *Attorney, Agent, or Firm* — Mike Frank Hughes

(57) ABSTRACT

The present invention relates to a training firearm and more specifically, to a training firearm that mimics the trigger mechanism of real firearms. The training firearm comprises a frame, a break arm, a movable magnate, a frame magnet, a trigger, a reed switch and a shot indicator. On application of force, the trigger pushes the break arm to move the movable magnate closer to the reed switch. Once the magnetic field of moveable magnate is detected by the reed switch it turn on the shot indicator to shoot a laser.

16 Claims, 6 Drawing Sheets

TRAINING FIREARM

FIELD OF INVENTION

This invention relates to a training firearm, and more specifically, to a training firearm that mimics the trigger mechanism of real firearms.

BACKGROUND

Training firearms serve as essential tools for skill development, safety drills, and marksmanship practice. Whether it's a law enforcement officer practising tactical manoeuvres or a civilian learning self-defense, a reliable firearm training ensures that learners can hone their skills effectively. Training firearm is crucial because it can endure repeated handling without compromising its functionality. Instructors and trainees rely the firearm for the consistent performance during firearm training, and a robust firearm minimizes the risk of malfunctions or breakages. A reliable training firearm operates predictably, replicating the essential features of a functional firearm.

Conventionally, traditional firearms have been widely used for such skill development, safety drills, and marksmanship practice. However, traditional firearms have been expensive to manufacture, maintain, and operate. Further, ammunition costs, maintenance, and wear-on components contribute significantly to the overall expense. Moreover, traditional training firearms may not withstand the rigorous demands of frequent training sessions and fail to mimic the feel of using an actual firearm.

Accordingly, there is a need for a training firearm that is robust, reliable, economical and can mimic the feel of an actual firearm.

SUMMARY OF THE INVENTION

In view of the foregoing disadvantages inherent in the prior art, the general purpose of the present disclosure is to provide a training firearm, to include all advantages of the prior art, and to overcome the drawbacks inherent in the prior art.

Some of the objects of the present invention, which at least one embodiment herein satisfies, are as follows:

An object of the present invention is to ameliorate one or more problems of the prior art or to at least provide a useful alternative. An object of the present disclosure is to provide a training firearm.

Another object of the present invention is to provide a training firearm that mimics the trigger mechanism of real firearms.

Other objects and advantages of the present disclosure will be more apparent from the following description, which is not intended to limit the scope of the present disclosure.

In an aspect, the present disclosure provides a training firearm. The training firearm comprises a frame, a break arm, a frame magnet, a trigger, a reed switch and a shot indicator. The frame has a grip portion and an upper portion. The break arm is movably attached within the frame. The break arm has a movable magnet attached thereto and is operatively configured to move with respect to the frame. The break arm has the rest position and an operating position with respect to the frame. The frame magnet is attached to the frame and aligned having similar polarity to the movable magnet so there has to be an attraction there between the break arm having a rest position with respect to the frame whereby force is required to separate the movable magnet from the frame magnet. The trigger is movably attached to the frame and operatively configured to displace in a longitudinally rearward direction. The trigger has a resting position when the trigger is in a longitudinally forward position with respect to the frame. The reed switch is fixedly attached to the frame whereby the reed switch is operatively configured to have a switch sensitivity field where magnetic disturbance within the switch sensitivity field activates the reed switch. The shot indicator is in electrical communication with the reed switch and a power source, whereby the shot indicator is configured to turn on and draw voltage from the power source through the reed switch when the reed switch is activated. The movable magnet of the break arm is operatively configured to reposition in the frame to place the magnetic field of the movable magnet within the switch sensitivity field whereby activating the reed switch as the break arm repositions from the rest position to the operating position. The break arm repositions from the rest position to the operating position by way of the longitude rearward motion of the trigger which repositions the break arm so the movable magnet is at a distance from the frame magnet greater than when the break arm is in the rest position. As the movable magnet separates from the frame magnet thereby enabling a non-linear drop in force with respect to the distance between the movable magnet and the frame magnet or by causing lower force to continue rearward force past the rest position of the trigger and further the movable magnet carries inertia from repositioning of the trigger in the longitudinally rearward direction to reposition the movable magnet within the switch sensitivity field of the reed switch whereby activating the reed switch to supply voltage from the power source to the shot indicator.

In another aspect, the present disclosure provides a method of operating the training firearm. The method begins with the step of utilizing a frame with a trigger that is movably attached to and configured to reposition from a rest position to a longitudinally rearward position with respect to the frame and repositioning of the trigger separates a frame magnet that is fixedly attached to the frame from a movable magnet where the movable magnet at the rest position is positioned adjacent to the frame magnet, whereby aligned flex field creates a force therebetween to draw the movable magnet and the frame magnet together and the force intern is directed to reposition the trigger to a longitudinally forward position, whereby force on the trigger in a longitude rearward direction separates the movable magnet from the frame magnet.

The method further comprises a step of repositioning the trigger, by an end user, in the longitude rearward direction whereby separating the movable magnet from the frame magnet which simulates the break arm of the trigger to a live fire pistol and as the movable magnet repositions away from the frame magnet, the movable magnet passes through a switch sensitivity field of a reed switch whereby activating the reed switch which intern activates a shot indicator, whereby the movable magnet serves two functions of providing a break like force of the trigger and providing a method to activate a switch which intern activate the shot indicator.

These elements, together with the other aspects of the present invention and various features are pointed out with particularity in the claims annexed hereto and form a part of the present invention. For a better understanding of the present invention, its advantages, and the specified object attained by its uses, reference should be made to the accompanying drawings and descriptive matter in which there are illustrated exemplary embodiments of the present invention.

BRIEF DESCRIPTION OF DRAWING

The foregoing summary, as well as the following detailed description of various embodiments, is better understood when read in conjunction with the drawings provided herein. For the purposes of illustration, there are shown in the drawings exemplary embodiments; however, the presently disclosed subject matter is not limited to the specific methods and instrumentalities disclosed.

Like reference numerals refer to like parts throughout the description of several views of the drawing.

DETAILED DESCRIPTION OF THE INVENTION

Figure 1:
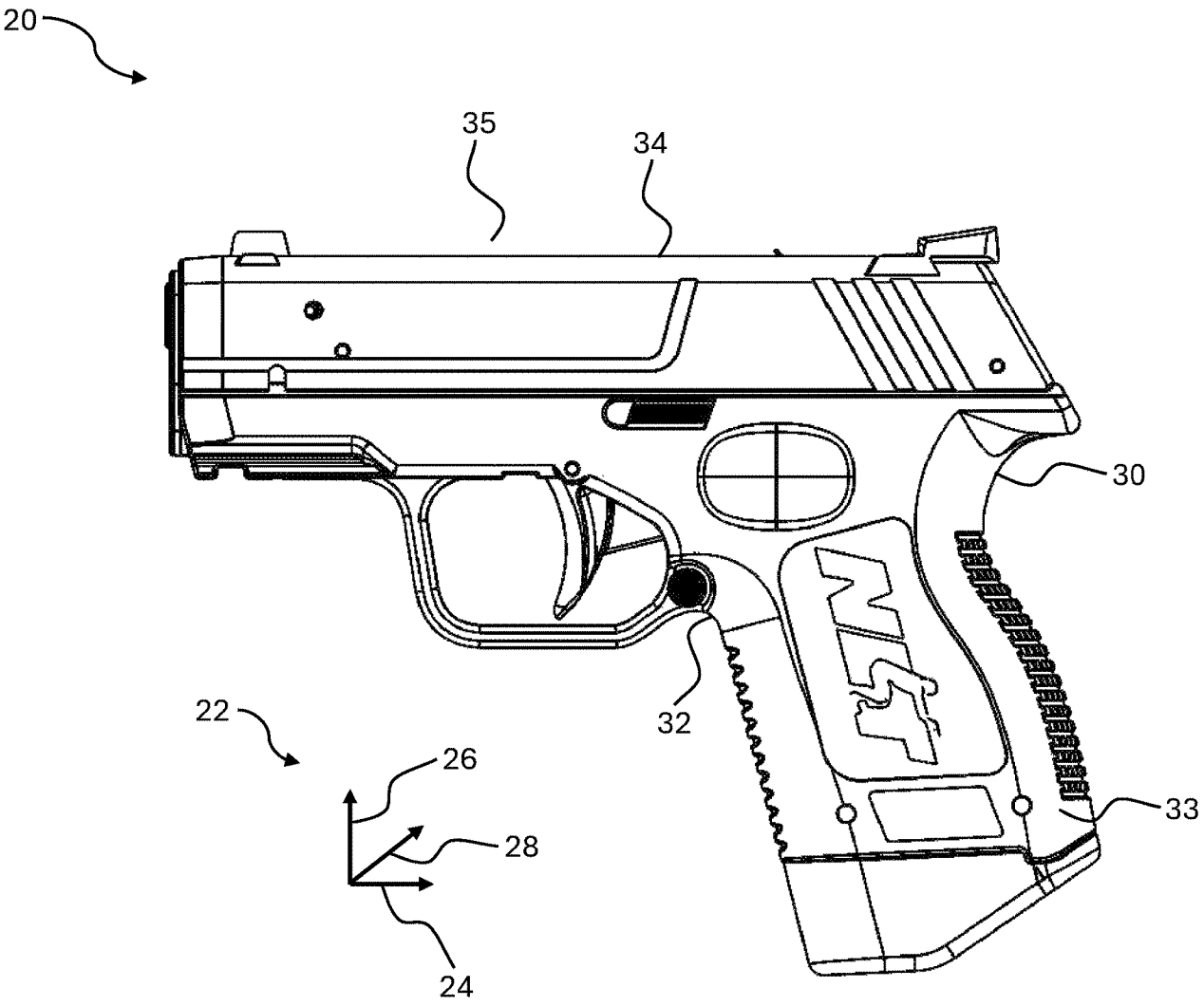
FIG. 1 illustrates a side view of a training firearm, according to an exemplary embodiment of the present disclosure.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open-ended transitional phrases and therefore specify the presence of stated features, integers, steps, operations, elements, modules, units and/or components, but do not forbid the presence or addition of one or more other features, integers, steps, operations, elements, components, and/or groups thereof. The particular order of steps disclosed in the method and process of the present disclosure is not to be construed as necessarily requiring their performance as described or illustrated. It is also to be understood that additional or alternative steps may be employed.

The following detailed description should be read with reference to the drawings, in which similar elements in different drawings are identified with the same reference numbers. The drawings, which are not necessarily to scale, depict illustrative embodiments and are not intended to limit the scope of the disclosure.

It is to be understood that both the foregoing general description and the following detailed description are exemplary and explanatory only and are not restrictive of the invention, as claimed. In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements and components comprising one unit and elements or components that comprise more than one unit unless specifically stated otherwise.

The present invention is directed towards a training firearm and more specifically, to a training firearm that mimics the trigger mechanism of real firearms. Firearm training is conducted in many states and countries and are strongly encouraged to be proficient with the firearm where safety is inextricably intertwined with proficiency. The training firearms of the present invention are more robust, reliable and economical.

In an aspect, the present disclosure provides a training firearm. The training firearm comprises a frame, a break arm, a frame magnet, a trigger, a reed switch and a shot indicator.

The frame has a grip portion and an upper portion. The break arm is movably attached within the frame. The break arm has a movable magnet attached thereto and is operatively configured to move with respect to the frame. The break arm has the rest position and an operating position with respect to the frame. The frame magnet is attached to the frame and aligned having similar polarity to the movable magnet so there has to be an attraction there between the break arm having a rest position with respect to the frame whereby force is required to separate the movable magnet from the frame magnet.

The trigger is movably attached to the frame and operatively configured to displace in a longitudinally rearward direction. The trigger has a resting position when the trigger is in a longitudinally forward position with respect to the frame.

The reed switch is fixedly attached to the frame whereby the reed switch is operatively configured to have a switch sensitivity field where magnetic disturbance within the switch sensitivity field activates the reed switch.

The shot indicator is in electrical communication with the reed switch and a power source, whereby the shot indicator is configured to turn on and draw voltage from the power source through the reed switch when the reed switch is activated.

The movable magnet of the break arm is operatively configured to reposition in the frame to place the magnetic field of the movable magnet within the switch sensitivity field whereby activating the reed switch as the break arm repositions from the rest position to the operating position.

The break arm repositions from the rest position to the operating position by way of longitude rearward motion of the trigger which repositions the break arm so the movable magnet is at a distance from the frame magnet greater than when the break arm is in the rest position.

As the movable magnet separates from the frame magnet thereby enabling a non-linear drop in force with respect to the distance between the movable magnet and the frame magnet or by causing lower force to continue rearward force past the rest position of the trigger and further the movable magnet carries inertia from repositioning of the trigger in the longitudinally rearward direction to reposition the movable magnet within the switch sensitivity field of the reed switch whereby activating the reed switch to supply voltage from the power source to the shot indicator.

The break arm is pivotally attached at a rotation point, whereby the break arm rotates with resorts to the frame and the movable magnet is positioned at a first end of the break arm with respects to the rotation point of the break arm.

The frame comprises a subframe assembly, wherein the subframe assembly comprises a subframe to house the break arm. The subframe is comprised of a first and a second half, whereby the second half operates as a cover over the first half and the first half rotationally mounts the break arm there in about the rotational portion.

The trigger is rotationally mounted at a trigger rotation point and a break arm engagement surface is operationally configured to make contact with a trigger engagement surface on the break arm whereby applying a force on the break arm to reposition the movable magnet from the frame magnet.

The distance from the break arm engagement surface at the point of engaging the trigger engagement surface of the break arm is a distance from the rotational portion of the break arm that is defined as the first leverage distance and the distance from the center of flux field of the movable magnet and the frame magnet from the rotational position of the break arm is defined as a second leverage distance whereby the first leverage distance is less or have a lower value than the second leverage distance. The first leverage distance is less than ½ of the second leverage distance. The first leverage distance is less than or equal to one-third of the second leverage distance.

The shot indicator is a laser that emits a laser beam in a forward portion of the training firearm and the power source is a battery. The grip portion of the frame houses a weight to increase the mass of the training firearm. The trigger is pivotally attached at a trigger rotation point and the trigger has the break arm engagement surface that is positioned longitude reward with respect to the trigger rotation point, the break arm is pivotally attached to the frame at a rotational portion where the break arm is operatively configured to rotate with respect to the frame, and the break arm further comprises a trigger engagement surface operatively configured to physically engage the break arm engagement surface of the trigger at a trigger-break arm engagement portion, whereby the distance from the trigger-break arm engagement portion, to the rotational portion is a lower value than the distance from the rotational portion to the movable magnet, whereby magnetic forces between the movable magnet and frame magnet has mechanical advantage thereupon the trigger-break arm engagement portion.

The break arm is rotationally mounted at the rotation portion to a subframe and the trigger is rotationally mounted at the trigger rotation portion to the base frame where the base frame with the subframe forms the frame.

In another aspect, the present disclosure provides a method of operating the training firearm. The method begins with the step of utilizing a frame with a trigger that is movably attached to and configured to reposition from a rest position to a longitudinally rearward position with respect to the frame and repositioning of the trigger separates a frame magnet that is fixedly attached to the frame from a movable magnet where the movable magnet at the rest position is positioned adjacent to the frame magnet, whereby aligned flex field creates a force there between to draw the movable magnet and the frame magnet together and the force intern is directed to reposition the trigger to a longitudinally forward position, whereby force on the trigger in a longitude rearward direction separates the movable magnet from the frame magnet.

The method further comprises a step of repositioning the trigger, by an end user, in the longitude rearward direction whereby separating the movable magnet from the frame magnet which simulates the break arm of the trigger to a live fire pistol and as the movable magnet repositions away from the frame magnet, the movable magnet passes through a switch sensitivity field of a reed switch whereby activating the reed switch which intern activates a shot indicator, whereby the movable magnet serves two functions of providing a break like force of the trigger and providing a method to activate a switch which intern activate the shot indicator. The shot indicator is a laser and is powered by a battery. The movable magnet separates from the frame magnet at a rate that is greater than the rate at which the trigger moves along acutely rearward direction at the trigger tip period. The trigger translates in the rearward direction and the break arm engagement surface repositions the break arm.

An exemplary embodiment of the present invention is now described in line with the FIGS. 1-6. As illustrated in FIG. 1, the present invention provides a training firearm 20. To aid in the description of the training firearm 20, attention is directed to an axis system 22 where an arrow 24 indicates a longitudinal axis and points in a longitudinal rearward direction. Further, an arrow 26 indicates a vertical direction, and at a base portion substantially orthogonal to the arrows 24 and 26 at 28 generally indicating a lateral direction otherwise referred to as left or right with respect to the training firearm 20. Of course, the axis system 22 is generally put forth and defined for general reference purposes and is not necessarily intended to be limiting upon the orientation of components and elements described herein. It should be noted that the training firearm 20 can be of a variety of form factors, such as, a pistol, a rifle, subcompact units, full size units etc. whereas the particular platform shown herein in FIG. 1 generally resembles a compact style training pistol.

In general, the training pistol 20 comprises a frame 30. The frame can be comprised of unitary or multiple components whereas a preferred form the frame 30 will be comprised of multiple components. As shown, in the exploded view of FIG. 2, the frame 30 is comprised of a base frame 32 having a grip portion 33, and a subframe 34 configured along an upper portion 35 of the frame 30. Referring now to FIG. 3, the subframe 34 is comprised of a first half 36 and a second half 38. In one preferred form, the first half 36 has an inner surface 41 defining a concave open area 40 that is operatively configured to house a variety of components therein which would be described in detail. For assembly purposes having the first half 36 with the inner surface 41 defining the concave open area 40 is desirable to assemble the various components as shown and FIG. 3 interposed between the first and second half 36 and 38, whereby the second half 38 functions as a cover otherwise refer to as a second-half cover, but again the frame 30 can be comprised of multiple pieces but is generally substantially fixed together to provide a base unit for the movable parts to move with respect thereto.

Still referring to FIG. 3 there is a break arm 44 housed in the subframe 34. In general, the break arm 44 is pivotally attached at a rotational portion 46. In one form, the rotational portion 46 is attached to the first and second half 36 and 38 so the break arm 44 rotates with respect to the frame 30.

The break arm 44 has a first end 48 with a receiving surface 50 that is operatively configured to have a movable magnet 52 attached thereto. In one form, the receiving surface 50 frictionally engages the movable magnet 52 or can have plastic injection through cores with overhang portions to fixedly attach the movable magnet 52 to the break arm 44.

Further, a frame magnet 54 may also be provided, which may be operatively configured to be fixedly attached to the frame 30 and in one preferred form to the first half 36 of the subframe 34 shown on the right side of FIG. 3 at the surfaces defining a cavity at 56. Therefore, now referring to FIG. 4, it can be appreciated how the break arm 44 pivotally attached at the rotational portion 46 to the frame 30 is in a rest position, whereby the first end 48 houses the movable magnet 52 therein (not shown in FIG. 4 but positioned therein the first end 48) is in very close proximity to the frame magnet 54 thereby the aligned poles of the magnets, such as the movable magnet 52 and the frame magnet 54 (hereinafter may be collectively referred to as 'magnets 52 and 54') bring a force therebetween pulling the break arm 44 in a downward position referred to as the rest position.

Figure 4:
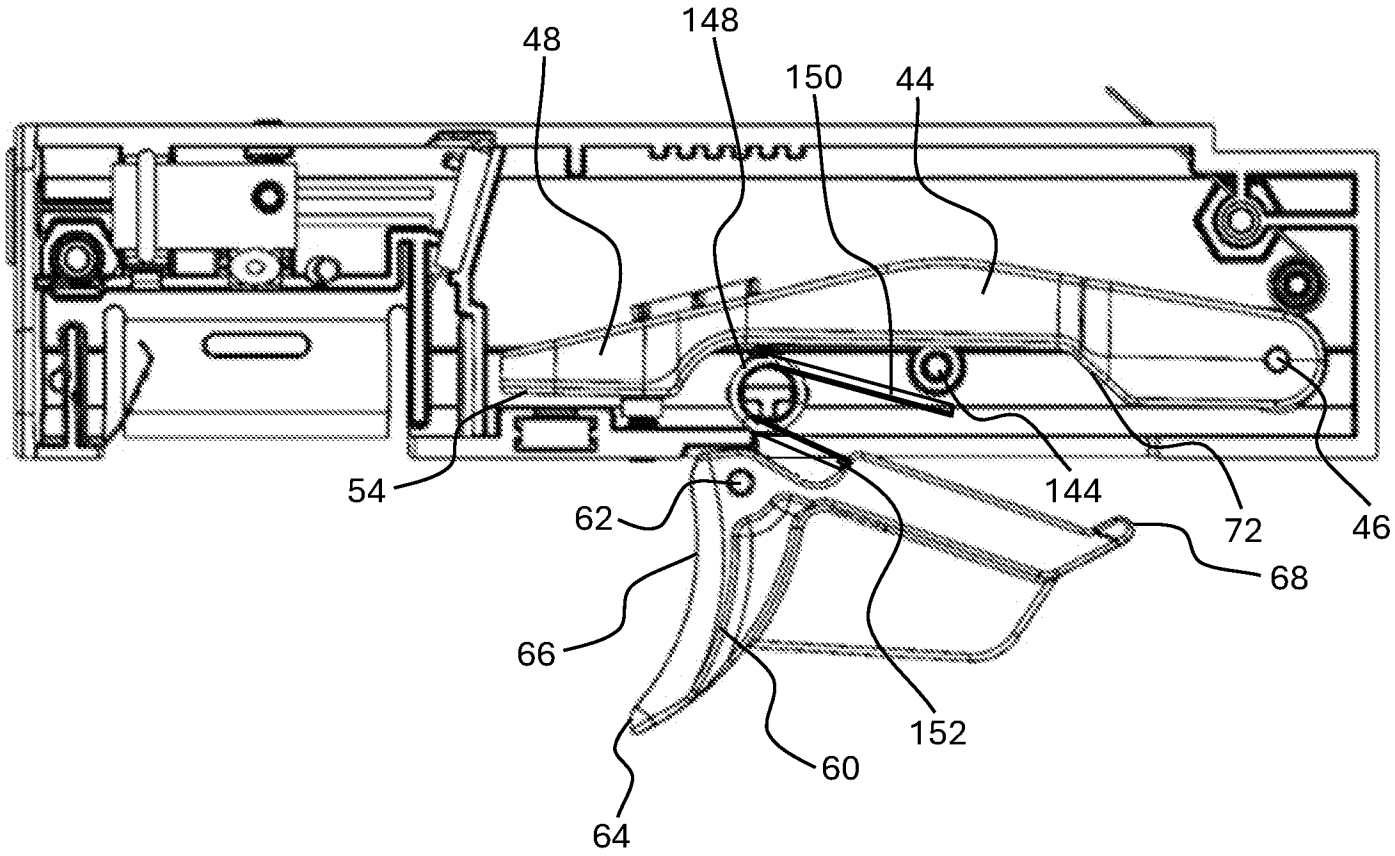
FIG. 4 illustrates a side cross-sectional view of the subframe with a trigger of the training firearm, wherein the trigger is in rest position, according to an exemplary of embodiment of the present invention.

To understand the operation of the preferred embodiment attention is still directed to FIG. 4 where it can be appreciated that a trigger 60 is pivotally attached to the frame 30, and one form the base frame 32, (not shown in FIG. 4) at a trigger rotation point 62.

The trigger 60 has a trigger tip 64 and a finger engagement surface 66 which is operatively configured to have pressure thereupon by an end user to press the trigger 60 in a longitudinally rearward direction. It should be noted in one form the trigger 60 will rotate or in another form the trigger 60 can translate reward such as to emulate 1911/2011 type design. The trigger 60 further comprises the break arm engagement surface 68 that is operably configured to engage a trigger engagement surface 72 described further herein.

Figure 6:
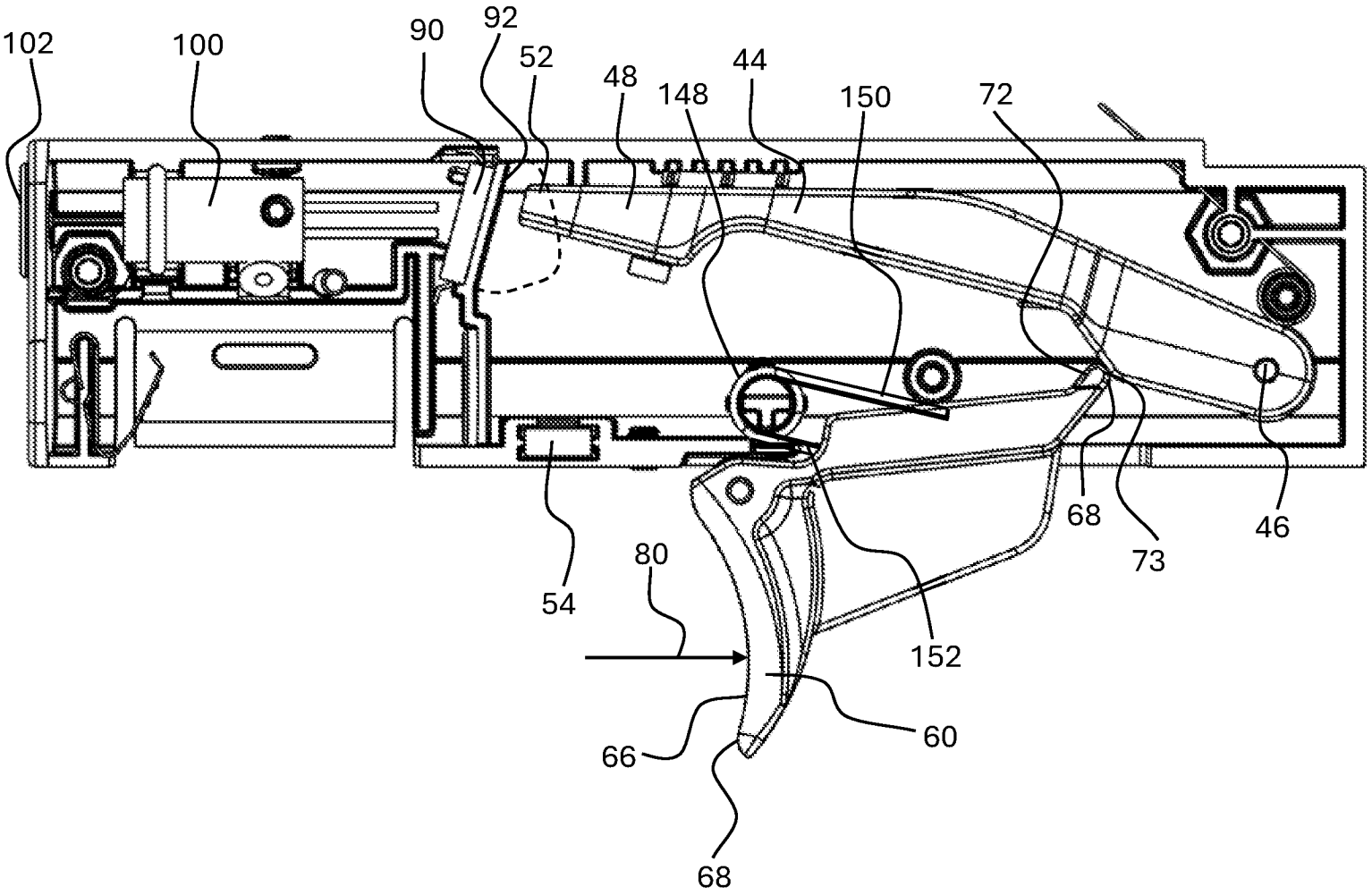
FIG. 6 illustrates a side cross-sectional view of the subframe with a trigger of the training firearm, wherein the trigger is in contact with the break arm but the frame magnate and the movable magnate are not in contact, and the movable magnate is in switch-sensitive field, according to an exemplary of embodiment of the present invention.

Continuing the description of the basic operation of the preferred embodiment, attention is now directed to FIG. 6 whereby it can be seen how the trigger 60 has a force indicated at 80 acting thereupon whereby repositioning the finger engagement surface 66 in a longitudinally rearward direction, the break arm engagement surface 68 is forcefully engaging the trigger engagement surface 72 and this area of engagement is referred to and defined as the "trigger-break arm engagement portion" 73 where it should be noted there is a distance between the trigger-break arm engagement portion 73 and the rotational portion 46 of the break arm 44. This distance is less than the distance from the rotational portion 46 and the movable magnet 52 (or the center of the flux field between the magnets 52 and 54). This distance causes mechanical advantage of the magnets 52 and 54 with respect to the trigger-break arm engagement portion 73 and this ratio can be 2:1, or 3:1 or up to 7:1 making it difficult to separate the magnets by way of the trigger movement. In other words, the motion of the trigger tip 64 can be one unit of distance and the distance of the first end 48 will be 3 units (or more) of distance.

The force of the trigger 60 exerted upon the break arm 44 at the trigger-break arm engagement portion 73 will eventually be sufficient so as the first end 48 of the break arm 44 will reposition, in this case upwardly, and the movable magnet 52 will separate in distance from the frame magnet 54, whereby there is a non-linear relationship of the force with respect to the distance between these magnets, such as the magnets 52 and 54. As the magnet 52 separates from the magnet 54, the amount of force therebetween drops off dramatically and as the force 80 continues on the trigger 60. Hence, there is a rather catastrophic "break" like feel that very much simulates the seer engagement break of a live fire pistol.

However, the movable magnet 52 has a rather novel and interesting operation as it moves to an operating position as shown in FIG. 6. A reed switch 90 which is of a conventional engineering design and has a switch sensitivity field generally indicated at an encircled portion 92 (hereinafter may be also be referred to as "switch sensitivity field" or "switch field") is sensitive to a magnetic flux field change whereby closing the reed switch 90 (or opening the reed switch 90 depending on the configuration of the circuitry). When the reed switch 90 is now in the operating position as shown and FIG. 6, the break arm 44 is in this case vertically upward (but of course could be orientated in different orientations but the concept is having the magnets 52 and 54 separated) and the magnetic flux field 92 of the movable magnet 52 has now interacted with the reed switch 90 whereby activating it to allow a shot indicator 100 to be activated. In one preferred form, the shot indicator 100 is a laser that emits a laser beam out of a forward end 102. In general, the shot indicator 100 can be an electrical communication with the reed switch 90 and with a power source 114 (hereinafter may be also be referred to as "battery" or "power supply) such as a battery (see FIG. 3 in the exploded view).

With the foregoing general conceptual description in place, attention will now be directed to FIG. 3 to explain some of the components in a preferred operating form.

As previously mentioned, the frame 30 can be partially comprised of the subframe 34 having the first half 36. A positive contact 110 is operatively configured to engage a positive terminal 112 of the battery 114 which operates the power supply/battery 114, and a negative contact 116 is operatively configured to engage a negative portion 120 of the power supply/battery 114. These are the conventional design and generally the negative terminal 116 is in electrical communication with a black negative wire (not shown in the figure) of the shot indicator 100.

It should be noted in one form, a bumper 122 can be provided and attached at a second location 124 of the break arm 44 so as to provide a slightly cushioned impact as it hits the ribs 130 of the first half 36 shown in the right-hand portion of FIG. 3. The trigger 60 in one form is pivotally attached to the subframe 34 via a pin 140. A stop pin 144 is provided to have a return spring 148 to have force thereon at an arm 150 whereas an arm 152 bias the trigger 60 to the forward position. Still referring to FIG. 3 should be noted it has been experimentally found having a metallic or otherwise magnetic material such as a simple washer 170 can be positioned at a third location 172 so as to prevent activation of the reed switch 90 when the movable magnet 52 is in the rest position such as that as shown in FIG. 4.

Figure 2:
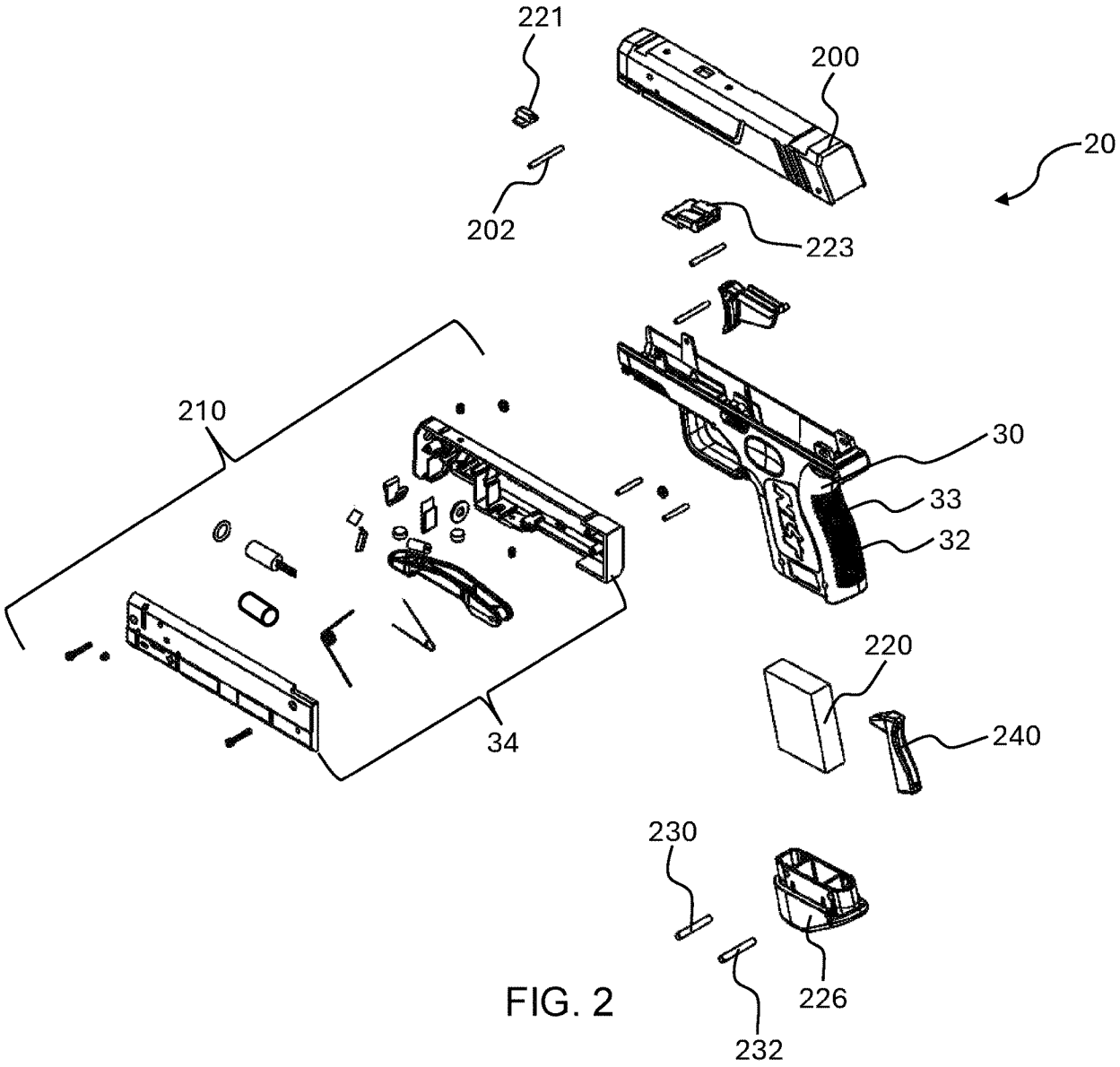
FIG. 2 illustrates an exploded view of the training firearm, according to an exemplary of embodiment of the present disclosure.
Figure 3:
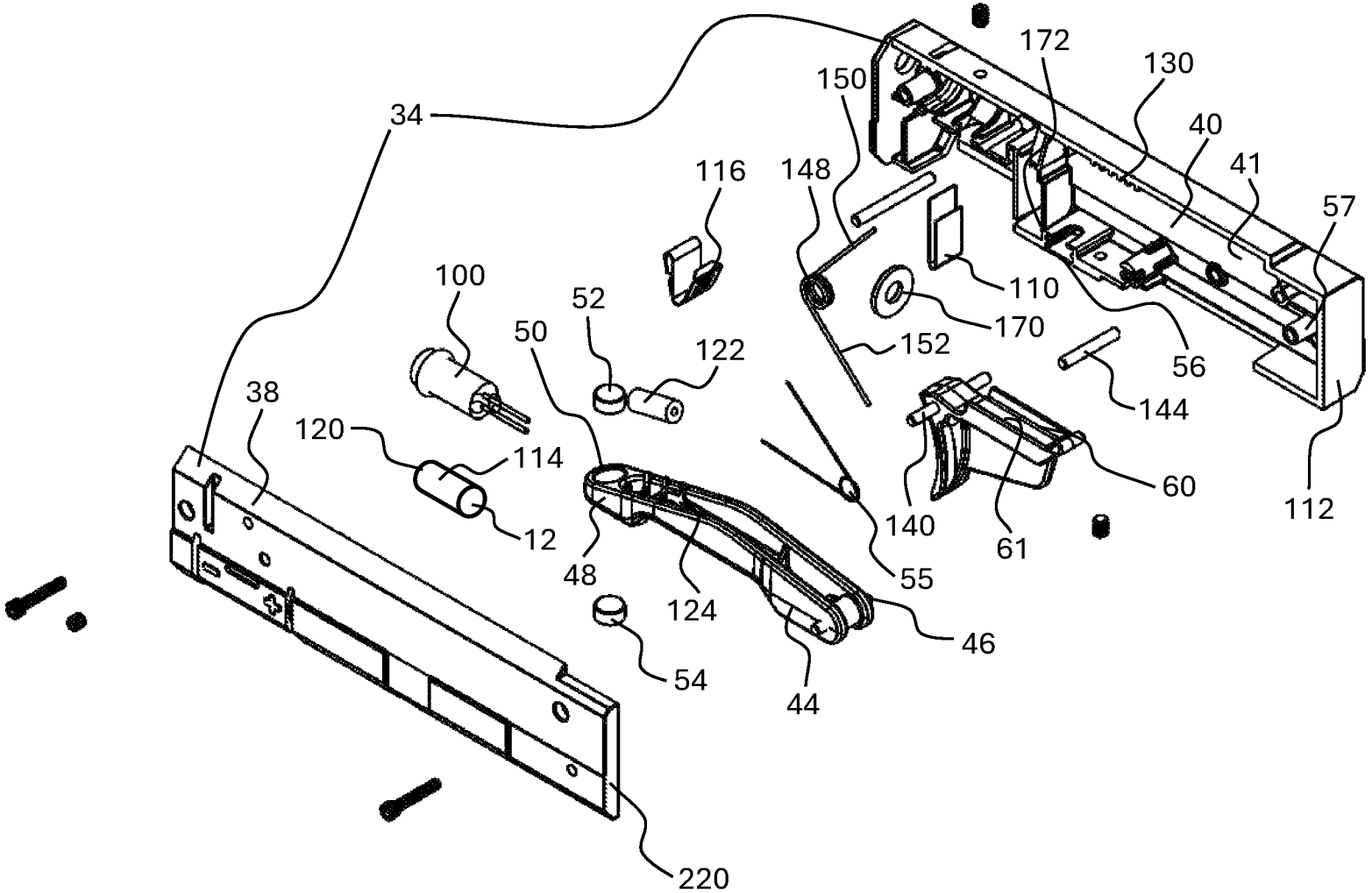
FIG. 3 illustrates an exploded view of a subframe of the training firearm, according to another exemplary embodiment of the present disclosure disclosed herein.

Referring now to FIG. 2, the various components of FIG. 3 are shown therein along with the base frame 32 and a slide 200. The slide 200 can be defined as part of the upper portion 35 of the frame 30 wherein one format is fixedly attached thereto but in a broader form could be movable to emulate slide reciprocation.

Pins such as that as shown as 202 can be used to attach the slide 200 to the base frame 32 and also pass there through a subframe assembly generally shown at 210 and comprise the various components, such as the subframe 34 and other components, shown and FIG. 3. A weight 220, in one form, may be housed or provided and fits within the grip portion 33 of the base frame 32 to provide mass or to increase mass to the training firearm 20. In one form, grip extensions 226 can be provided to have different extensions where it has been experimentally found different extensions can have different feels of the training platform to emulate different platforms such as short extensions, longer extensions, extensions with curves etc. The grip extensions 226 can be generally attached by pins 230 and 232 in one form but of course the weight 220 and the extension 226 can be attached to the base frame 32 by a plurality of methods. A weight anchor 240 is provided just to fixedly mount the weight 200 in the base frame 32.

Therefore, it can be appreciated that training firearm 20 can be made very economically with a very robust design with minimal components and electrical failure points. This design provides for tremendous longevity of the training firearm 20 whereby testing is shown that conventional reed switches can operate over 5 million cycles without failure while the operation of the full training firearm training 20 can go more than 700,000 trigger pull cycles without failure.

Final notes on the design referring back to FIG. 3, it has been found even though there is magnetic attraction between the magnets 52 and 54, a return spring 55 can be provided and be rotationally mounted at a first location 57 in the first half 36 so as to bias the break arm 44 from the operating position back down to the rest position. Further, as generally shown in FIG. 2, the slide 200 can have a front site 221 and a rear site 223 attached thereto and these sights can be replaceable as per conventional design.

The shot indicator 100 which in a preferred form is a laser can be a red laser, green laser or infrared laser, or any light frequency with pulses as per convention. There could be variations where the laser is constantly turned on via the reed switch and the reed switch deactivates the laser for period of time to allow functionality in certain training environments where a laser is always activated and only deactivated when the trigger 60 is pressed for certain larger training systems 20. In one form, the power supply 114 is a conventional battery such as a CR2 lithium battery or the power source can be rechargeable type design.

Figure 5:
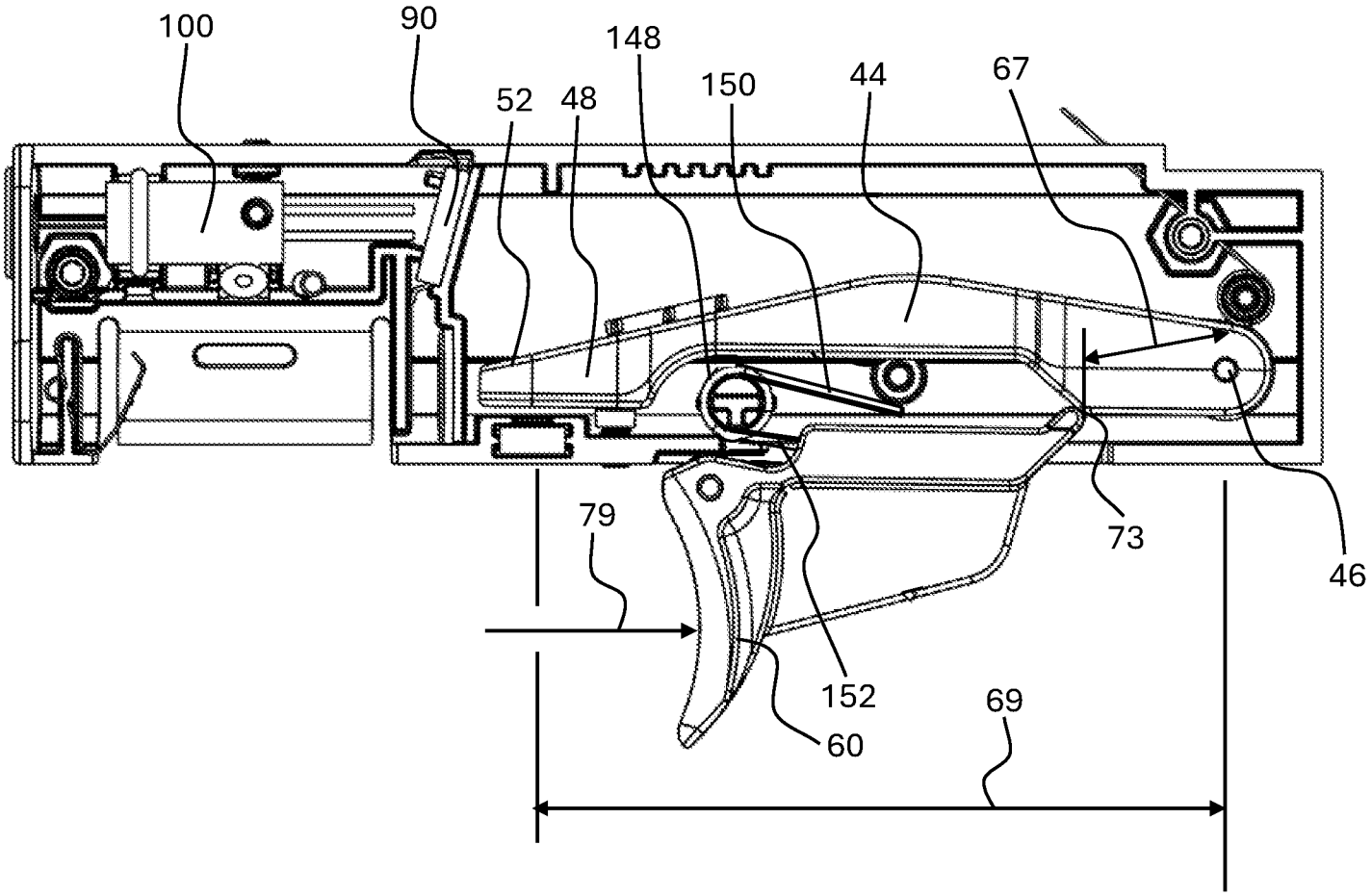
FIG. 5 illustrates a side cross-sectional view of the subframe with the trigger of the training firearm, wherein the trigger is in contact with a break arm but a frame magnate and a movable magnate are in contact, according to an exemplary of embodiment of the present invention.

There will now be a general recap discussion with reference to the partial assembly of the training firearm 20 with references to FIG. 4 through FIG. 6. As noted in FIG. 4, the trigger 60 is in a resting position whereby shown the general orientation of the spring 148 but it can be appreciated that the arm 150 is placing pressure upon the pin 144 and the arm 152 is in the surface defining the cavity 61 (as shown in FIG. 3) to bias the finger engaging surface 66 forward in the longitudinal direction. Now referring to FIG. 5, it can be appreciated that a force as indicated by an arrow 79 is applied to the trigger 60 acting, in effect, as a trigger take up which is conventional in most firearms. When there is contact between the trigger 60 and the break arm 44 at the defined trigger-break arm engagement portion 73, referring to FIG. 6, it can be appreciated that the reward force in the longitudinal direction 80 is now less than the force 79 of FIG. 5 because the magnets 52 and 54 are separated therefrom one another. With regard to the leverage, can be noted at the rotational portion 46, the distance indicated at 67 (or a first leverage distance 67) is less (or have a lower value) than the distance indicated at 69 (or a second leverage distance 69) defined between the center of the magnetic flux of the magnets 52 and 54 and the rotational portion 46. In one example, the first leverage distance 67 may be less than ½ of the second leverage distance. In another example, the first leverage distance 67 may be less than or equal to one-third of the second leverage distance 69. Therefore, as mentioned above, the magnets 52 and 54 have mechanical advantage in the force applied downward on the break arm 44 with respect to the force supplied at the trigger-break arm engagement portion 73, which is applied upward (or an opposing direction in general) on the break arm 44. This distance ratio of the first leverage distance 69 and the second leverage distance 67 also limits the amount of over travel of the trigger 60 (the trigger movement between FIGS. 5 and 6) and provides a greater range of motion of the first end 48 housing and hence the movable magnet 52 so the movable magnet effectively has a greater range of motion relative amount of motion of the trigger 60, say at the trigger tip 68 to provide a more generous "activated state" and "deactivated state" of the reed switch 90. This allows for a more robust design to make sure the reed switch 90 is clearly activating (FIG. 6) and clearly not activating (FIGS. 4-5) the shot indicator 100. Also, the larger range of motion of the movable magnet 52 provides a very clear broad activation zone such as that as shown within the switch sensitivity field 92 in FIG. 6 so the reed switch 90 is clearly activated (either by allowing current to pass through or not allowing current depending on the overall circuitry design).

The foregoing descriptions of specific embodiments of the present disclosure have been presented for purposes of illustration and description. They are not intended to be exhaustive or to limit the present disclosure to the precise forms disclosed, and many modifications and variations are possible in light of the above teaching. The embodiments were chosen and described to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the scope of the present disclosure.

What is claimed is:

1. A training firearm, comprising:

a frame having a grip portion and an upper portion;

a break arm movably attached within the frame, the break arm having a movable magnet attached thereto and operatively configured to move with respect to the frame, the break arm having a rest position and an operating position with respect to the frame;

a frame magnet attached to the frame and aligned having similar polarity to the movable magnet so as to have an attraction there between, the break arm having the rest position with respect to the frame whereby force is required to separate the movable magnet from the frame magnet;

a trigger movably attached to the frame and operatively configured to displace in a longitudinally rearward direction, the trigger having a resting position when the trigger is in a longitudinally forward position with respect to the frame;

a reed switch fixedly attached to the frame whereby the reed switch is operatively configured to have a switch sensitivity field where magnetic disturbance within the switch sensitivity field activates the reed switch;

a shot indicator in electrical communication with the reed switch, and a power source whereby the shot indicator is configured to turn on and draw voltage from the power source through the reed switch when the reed switch is activated;

wherein the movable magnet of the break arm is operatively configured to reposition in the frame to place the magnetic field of the movable magnet within the switch sensitivity field whereby activating the reed switch as the break arm repositions from the rest position to the operating position, wherein, the break arm repositions from the rest position to the operating position by way of longitude rearward motion of the trigger which repositions the break arm so the movable magnet is at a distance from the frame magnet greater than when the break arm is in the rest position, and wherein, as the movable magnet separates from the frame magnet, thereby enabling a non-linear drop in force with respect to the distance between the movable magnet and the frame magnet or by causing lower force to continue rearward force past the rest position of the trigger and further the movable magnet carries inertia from repositioning of the trigger in the longitudinally rearward direction to reposition the movable magnet within the switch sensitivity field of the reed switch, whereby activating the reed switch to supply voltage from the power source to the shot indicator.

2. The training firearm as claimed in claim 1, wherein the break arm is pivotally attached at a rotation point, whereby the break arm rotates with resorts to the frame and the movable magnet is positioned at a first end of the break arm with respects to the rotation point of the break arm.

3. The training firearm as claimed in claim 1, wherein the frame comprises a subframe assembly, wherein the subframe assembly comprises a subframe to house the break arm.

4. The training firearm as claimed in claim 3, wherein the subframe is comprised of a first half and a second half, whereby the second half operates as a cover over the first half and the first half rotationally mounts the break arm therein about the rotational portion.

5. The training firearm as claimed in claim 1, wherein the trigger is rotationally mounted at a trigger rotation point and a break arm engagement surface is operationally configured to make contact with a trigger engagement surface on the break arm whereby applying a force on the break arm to reposition the movable magnet from the frame magnet.

6. The training firearm as claimed in claim 5, wherein the distance from the break arm engagement surface at the point of engaging the trigger engagement surface of the break arm is a distance from the rotational portion of the break arm that is defined as the first leverage distance and the distance from the center of flux field of the movable magnet and the frame magnet from the rotational position of the break is defined as a second leverage distance, whereby the first leverage distance is less or have a lower value than the second leverage distance.

7. The training firearm as claimed in claim 6, wherein the first leverage distance is less than ½ of the second leverage distance.

8. The training firearm as claimed in claim 6, wherein the first leverage distance is less than or equal to one-third of the second leverage distance.

9. The training firearm as claimed in claim 1, wherein the shot indicator is a laser that emits a laser beam in a forward portion of the training firearm and the power source is a battery.

10. The training firearm as claimed and claim 9, wherein the grip portion of the frame houses a weight to increase the mass of the training firearm.

11. The training firearm as claimed and claim 9, wherein the trigger is pivotally attached at a trigger rotation point and the trigger has a break arm engagement surface that is positioned longitude reward with respect to the trigger rotation point, the break arm is pivotally attached to the frame at a rotational portion where the break arm is operatively configured to rotate with respect to the frame, and the break arm further comprises a trigger engagement surface operatively configured to physically engage the break arm engagement surface of the trigger at a trigger-break arm engagement portion, whereby the distance from the trigger-break arm engagement portion to the rotational portion is a lower value than the distance from the rotational portion to the movable magnet, whereby magnetic forces between the movable magnet and frame magnet has mechanical advantage thereupon the trigger-break arm engagement portion.

12. The training firearm as claimed in claim 11, wherein the break arm is rotationally mounted at the rotation portion to a subframe and the trigger is rotationally mounted at the trigger rotation portion to the base frame where the base frame with the sub subframe forms the frame.

13. A method of training firearm skills, comprising:

utilizing a frame with a trigger that is movably attached to and configured to reposition from a rest position to a longitudinally rearward position with respect to the frame and repositioning of the trigger separates a frame magnet that is fixedly attached to the frame from a movable magnet where the movable magnet at the rest position is positioned adjacent to the frame magnet, whereby the aligned flex field creates a force there between to draw the movable magnet and the frame magnet together and the force in turn is directed to reposition the trigger to a longitudinally forward position, whereby force on the trigger in a longitude rearward direction separates the movable magnet from the frame magnet;

repositioning the trigger, by an end user, in the longitude rearward direction whereby separating the movable magnet from the frame magnet which simulates a break arm of the trigger to a live fire pistol and as the movable magnet repositions away from the frame magnet, the movable magnet passes through a switch sensitivity field of a reed switch whereby activating the reed switch which in turn activates a shot indicator, whereby the movable magnet serves two functions of providing a break like force of the trigger and providing a method to activate a switch which in turn activate the shot indicator.

14. The method as claimed in claim 13, wherein the shot indicator is a laser and is powered by a battery.

15. The method as claimed in claim 14, wherein the movable magnet separates from the frame magnet at a rate that is greater than the rate at which the trigger moves along acutely rearward direction at the trigger tip period.

16. The method as claimed in claim 14, wherein the trigger translates in the rearward direction and a break arm engagement surface repositions the break arm.

* * * * *